United States Patent [19]

de Nora

[11] 4,065,367

[45] Dec. 27, 1977

[54] METHOD OF OPERATING AN ELECTROLYSIS CELL

[75] Inventor: Vittorio de Nora, Nassau, Bahamas

[73] Assignee: Oronzio de Nora Impianti Elettrochimici, S.p.A., Milan, Italy

[21] Appl. No.: 681,145

[22] Filed: Apr. 28, 1976

Related U.S. Application Data

[62] Division of Ser. No. 530,012, Dec. 5, 1974, Pat. No. 3,976,556.

[51] Int. Cl.[2] ..... C25B 1/16; C25B 1/26

[52] U.S. Cl. ..... 204/98; 204/128

[58] Field of Search ..... 204/98, 128, 262

[56] References Cited

U.S. PATENT DOCUMENTS

| | | | |
|---|---|---|---|
| 982,037 | 1/1911 | Crocker | 204/262 |
| 1,598,018 | 8/1926 | Schlumberger | 204/98 |
| 3,809,630 | 5/1974 | de Nora et al. | 204/290 F |
| 3,853,738 | 12/1974 | Loftfield et al. | 204/290 F |

*Primary Examiner*—R. L. Andrews

*Attorney, Agent, or Firm*—Hammond & Littell

[57] ABSTRACT

Describes a diaphragm electrolysis cell and method of operation in which water vapor is continuously or intermittently condensed on the cathode side of the diaphragm surface to dilute and remove the hydroxide containing film which forms on the cathode side of the diaphragm surface.

11 Claims, 13 Drawing Figures

S
50
50a
NaOH
43
40
35
49a
49
$H_2$
CONDENSATE
41
51
$Cl_2$
51a
43a
44a
44b
38a
47b
33
42
BRINE 47
47 BRINE
2
4
5

METHOD OF OPERATING AN ELECTROLYSIS CELL

This a division of Ser. No. 530,012, filed Dec. 2, 1974, now U.S. Pat. no. 3,976,556.

This invention relates to improvements in diaphragm electrolysis cells and in the method of operating electrolysis cells, particularly for use in the electrolysis of alkali halide brines to produce halogen gases, hydrogen and alkali metal hydroxides. The process and apparatus of this invention may be used in the electrolysis of sodium potassium and lithium chlorides, bromides and iodides and other halogenides, for the electrolysis of other salts which undergo decomposition under electrolysis conditions and for other purposes.

As a specific illustration of the practice of this invention, the electrolysis of sodium chloride brine to produce chlorine, sodium hydroxide and hydrogen will be described, but it is to be understood that this is only for the purpose of illustration and that all other uses of the processes and apparatus hereinafter described and modifications thereof are within the scope of this invention.

In the electrolysis of sodidum chloride brine in diaphragm-type electrolysis cells, chlorine is discharged at the anode and because of the low hydrogen overvoltage of the metal of the cathode, hydrogen, in preference to sodium, is discharged at the cathode, leaving the sodium ions and the hydroxyl (remaining from the ionization of the $H_2O$ from which the hydrogen was produced), to combine in the cathodic film to form sodium hydroxide. The same is true for potassium hydroxide and other alkali metal hydroxides. The cathodes are usually of ferrous metal in screen form, but any suitable conductive material in any desired foraminous form, such as perforate plate, expanded mesh, woven screens, etc., may be used. The term "cathode screen" will be used to refer to all cathodes no matter what the form.

In the practice of this invention, the cathode screens are largely surrounded by a gaseous phase, the screens being slightly wetted either by the electrolyte percolating through porous diaphragms or by steam condensed on the cathode side of the diaphragms or by water sprayed in an amount sufficient to bridge the spaces between the active cathode surfaces and the fluid permeable or ion permeable diaphragms, the amount of the liquid phase being sufficient to allow ionic current to flow to the cathodes.

The word "diaphragm" is used herein to described the separating means between the anodic and the cathodic compartments of an electrolysis cell. The word "diaphragm" is intended to include all types of separating means currently used in electrolysis cells, such as fluid permeable asbestos or modified asbestos-type diaphragms, fluid impermeable ion permeable diaphragms, ion permeable diaphragms with controlled liquid porosity, ion permeable liquid impermeable diaphragms and all other types of diaphragms.

Diaphragm electrolysis cells either of the monopolar or bipolar type have an anode compartment into which anolyte in the form of substantially saturated brine is fed and which houses the anodes which may be graphite and in the more modern cells are dimensionally stable anodes and a cathode compartment housing the cathodes. Diaphragms separate the anode and cathode compartments. The cathodes in the vertical electrode cells are hollow and, in the case of porous diaphragms, when the electrolyte filters through the diaphragm, the hollow cathodes permit the collection of the catholyte which contains caustic soda and sodium chloride in the bottom of the cathode compartments. The caustic soda concentration usually reaches 120 – 130 gpl of sodium hydroxide and in some cases even higher. However, as the concentration increases above 130 gpl of sodium hydroxide, the current efficiency decreases, so that when the concentration reaches 160 gpl the current efficiency is usually about 90%. It is, therefore, impossible to have the catholyte at high concentration without losing current efficiency. The reduction of current efficiency is due to several factors of which the most important is the back migration of hydroxyl ions from the cathode compartment into the anode compartment, which causes the formation of hypochlorite and chlorate which, in turn, passes again into the cathode compartment and contaminates the catholyte which will contain a certain amount of chlorate which will be higher, the higher the concentration of caustic in contact with the cathode side of the porous diaphragm. This back migration of hydroxyl ions is reduced when the flow of electrolyte from the anode to the cathode compartment is increased. However, to increase the flow of electrolyte to the cathode compartment and still maintain the desired concentration of caustic in the catholyte, higher current densities are necessary.

In cells having horizontal cathodes and anodes separated by porous diaphragms, the flow of electrolyte through the diaphragms is more uniform because the pressure of the liquid on the diaphragm is uniform over the entire surface.

In cells having vertical anodes and cathodes and diaphragms, the flow is not uniform, particularly in that section of the cathode in which no catholyte is present.

In cells with permionic membranes, the back migration of hydroxyl ions is prevented, but new and different operative problems are introduced such as the difficulty of ensuring a good ionic conduction medium between the membrane and the cathode and to provide for an efficient and easy disengagement of hydrogen gas evolved on the cathode surface.

One of the objects of this invention is to provide a cell in which the conditions of operation are such that a caustic of high purity and high concentration is obtained without reduction of the current efficiency.

Another object is to constantly dilute and remove the caustic film from the cathode side of the diaphragms and thereby improve the efficiency of the electrolysis process.

Another object is to constantly wash the cathode side of the diaphragms with condensed water to dilute and remove the alkali metal hydroxide aqueous films from the cathode side of the diaphragms, so that the concentration of hydroxyl ions in this film is kept low and the efficiency of the electrolysis process is not greatly reduced by the back migration of hydroxyl ions through the diaphragm. The condensation water is preferably obtained by keeping the temperature of the diaphragms and of the anolyte below the dew point temperature of the water vapor in the cathode compartments.

Another object of this invention is to operate the cathode compartment of diaphragm electrolysis cells at a higher temperature than the temperature of the anolyte and the anode compartment, so that the percolation or migration of the cooler anolyte through the diaphragm into the hotter cathode compartment, the upper part of which is filled with steam, will cause condensation of steam on the cathode side of the diaphragms and on the adjacent cathode screens to constantly wash the cathode side of the diaphragms and the cathode surface with water which dilutes the cathodic aqueous film and prevents build-up of alkali metal hydroxide concentration on the cathode side of the diaphragms.

Another object is to flood the cathode compartment of a diaphragm electrolysis cell with steam which is condensed on the cathode side of the diaphragms by the cooler anolyte liquor percolating through porous diaphragms or in contact with the diaphragms to dilute the alkali metal hydroxide in the liquid film on the cathode side of the diaphragms.

Another object is to constantly wash the cathode side of the diaphragms with steam, condense the steam on the cathode side of the diaphragms and on the cathode screens and flow the excess condensate off the cathode side of the diaphragms.

Another object is to provide electrolysis cells in which the processes described herein can be carried out.

Another object is to provide an electrolysis cell with an anode compartment having a chamber for liquid anolyte and a space for anodic gas above the liquid anolyte, a cathode compartment having a chamber for collecting the catholyte liquor and a space for catholyte gas above the catholyte liquor, the cathodes and anodes being separated by diaphragms and means to connect the anodes and cathodes into an electrical circuit.

Various other objects of this invention will appear as this description proceeds.

The invention may be practiced in diaphragm electrolysis cells with horizontal anodes and cathodes, and in diaphragm cells with vertical or substantially vertical anodes and cathodes, and in which the diaphragms are either porous, water absorbent or substantially non-porous permionic membranes.

Referring now to the drawings which illustrate various forms of electrolysis cells in which this invention may be practiced:

Figures 3, 4, 5:
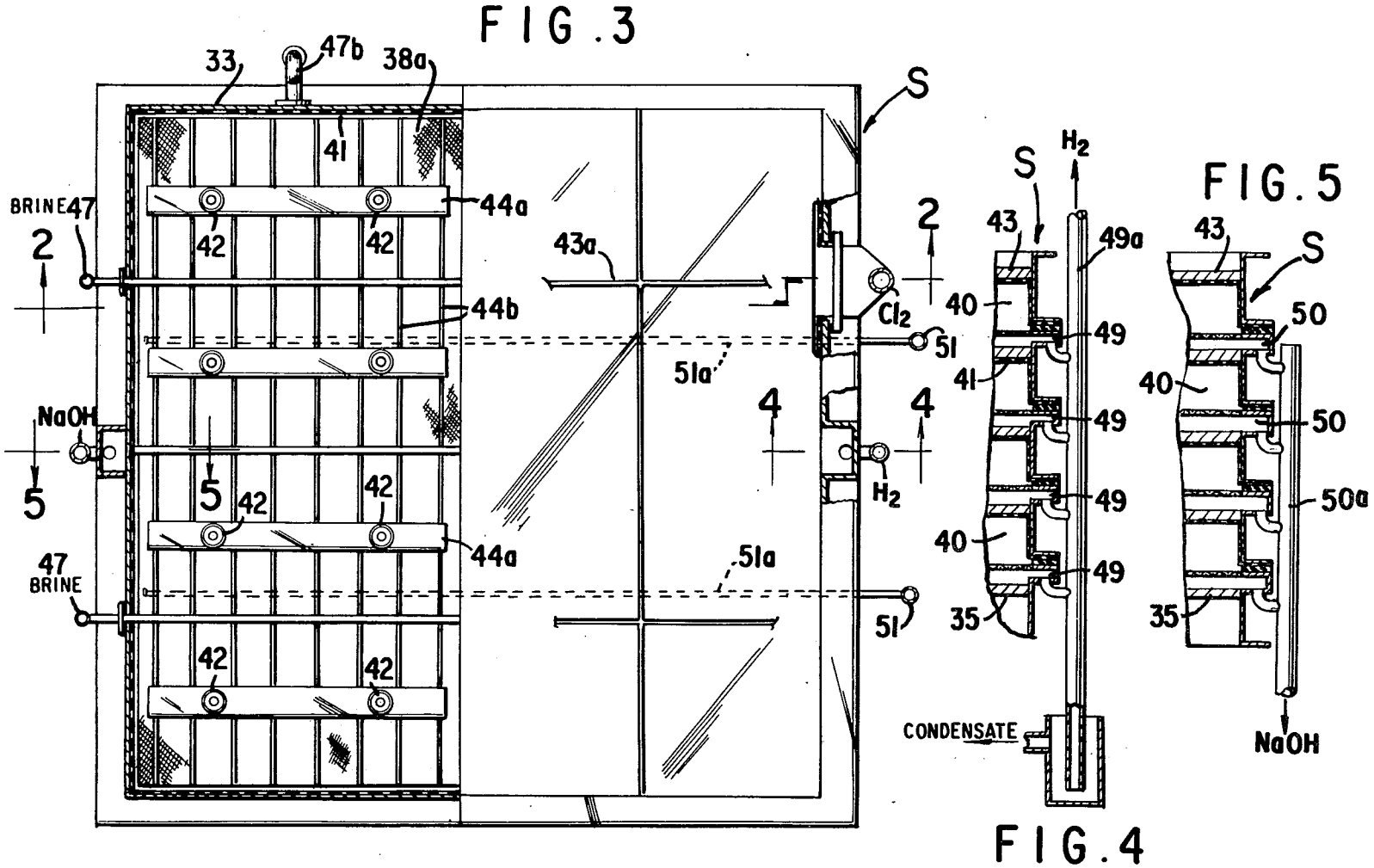
FIG. 3 is a plan view, partially in section, of the cell illustrated in FIG. 2.
Figure 6:
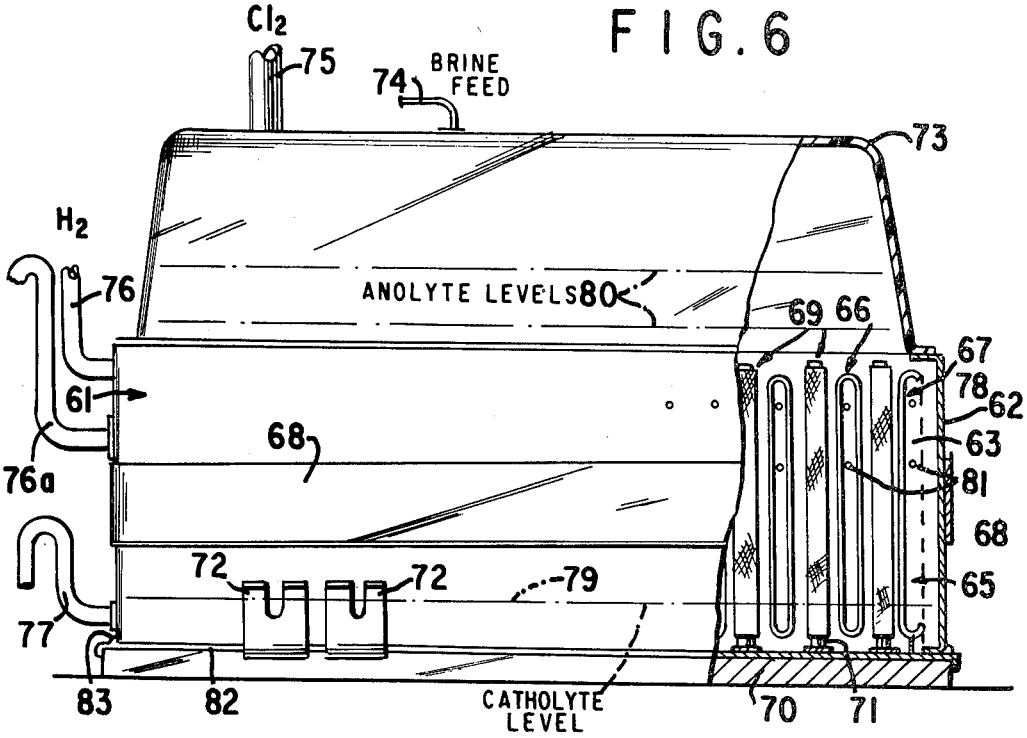
Figure 7:
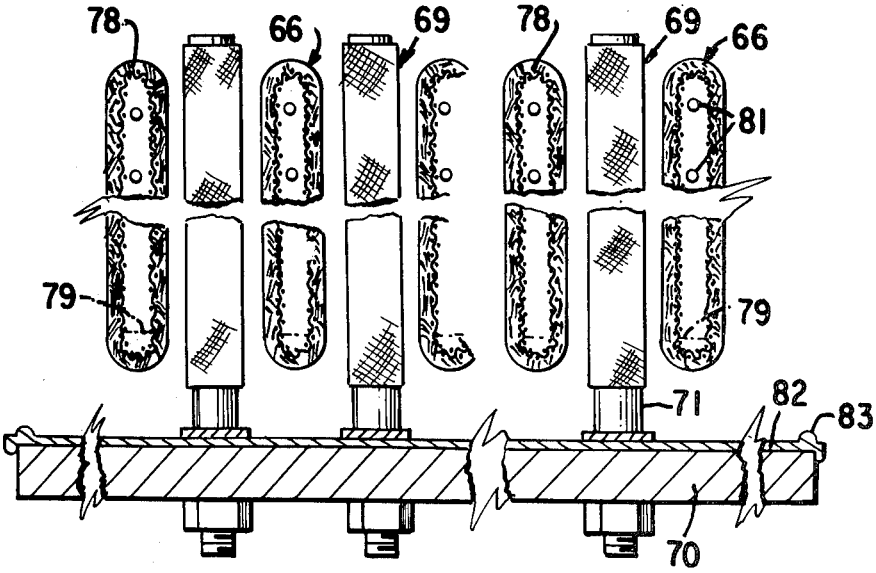
Figure 8:
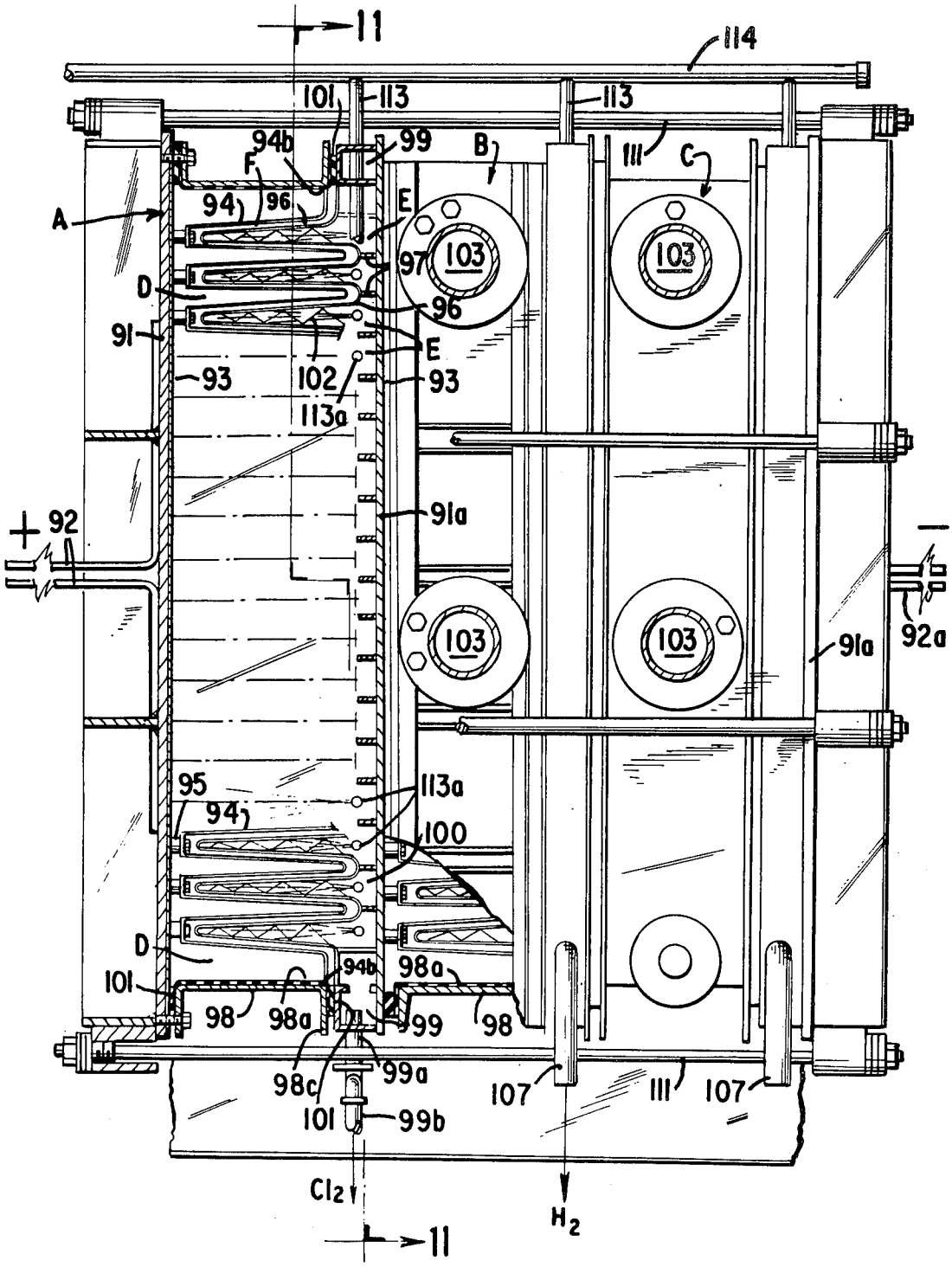
Figure 9:
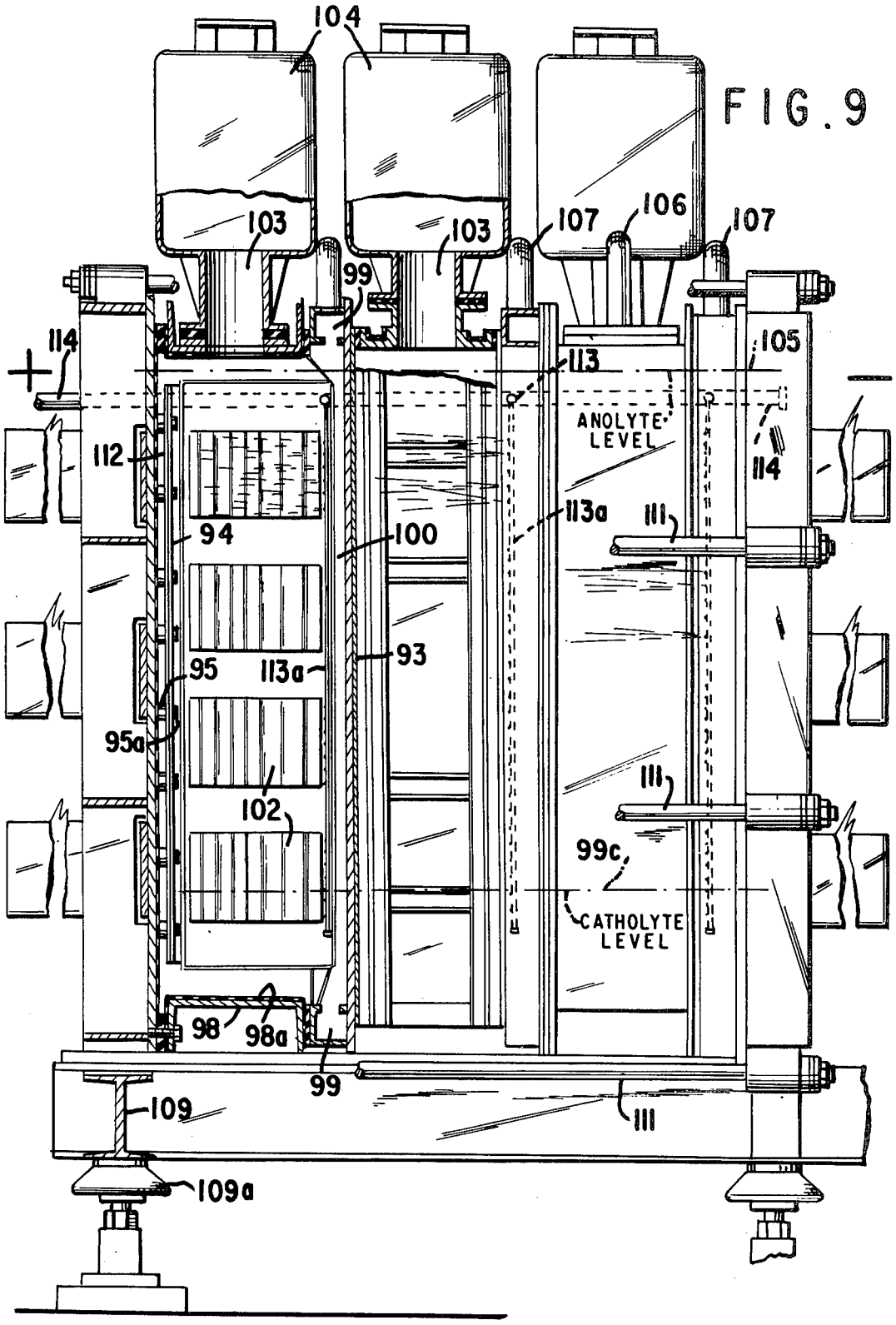
Figure 10:
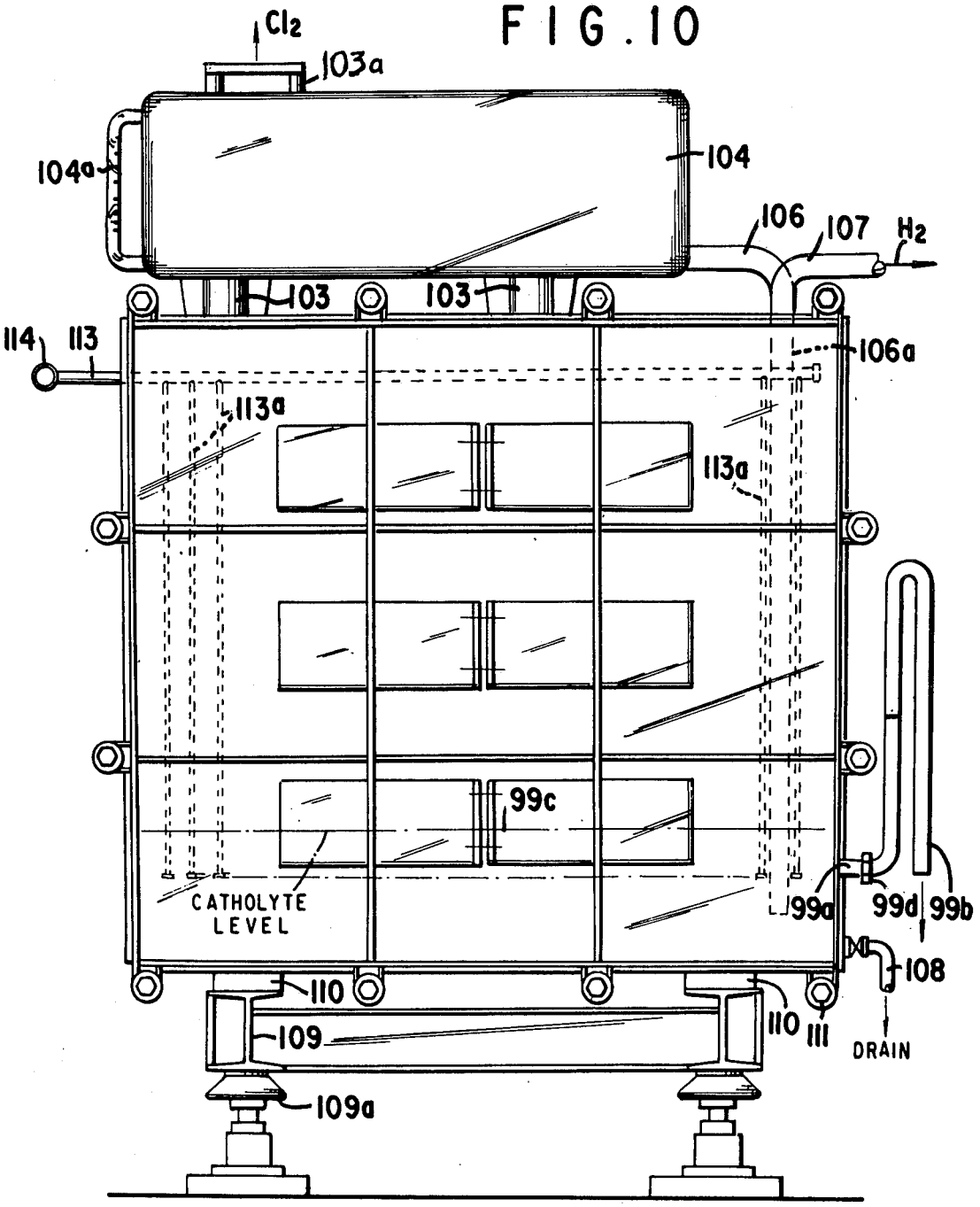
Figure 11:
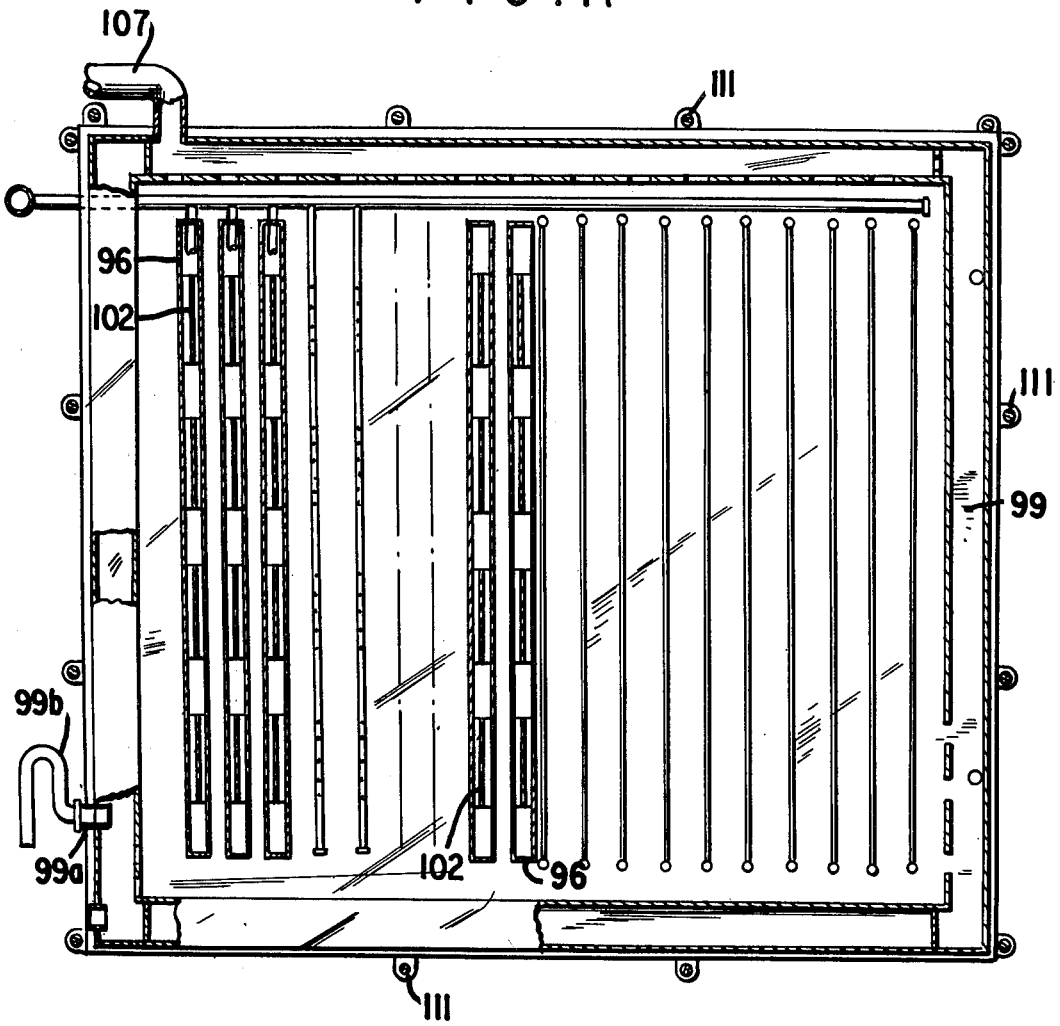
Figure 12:
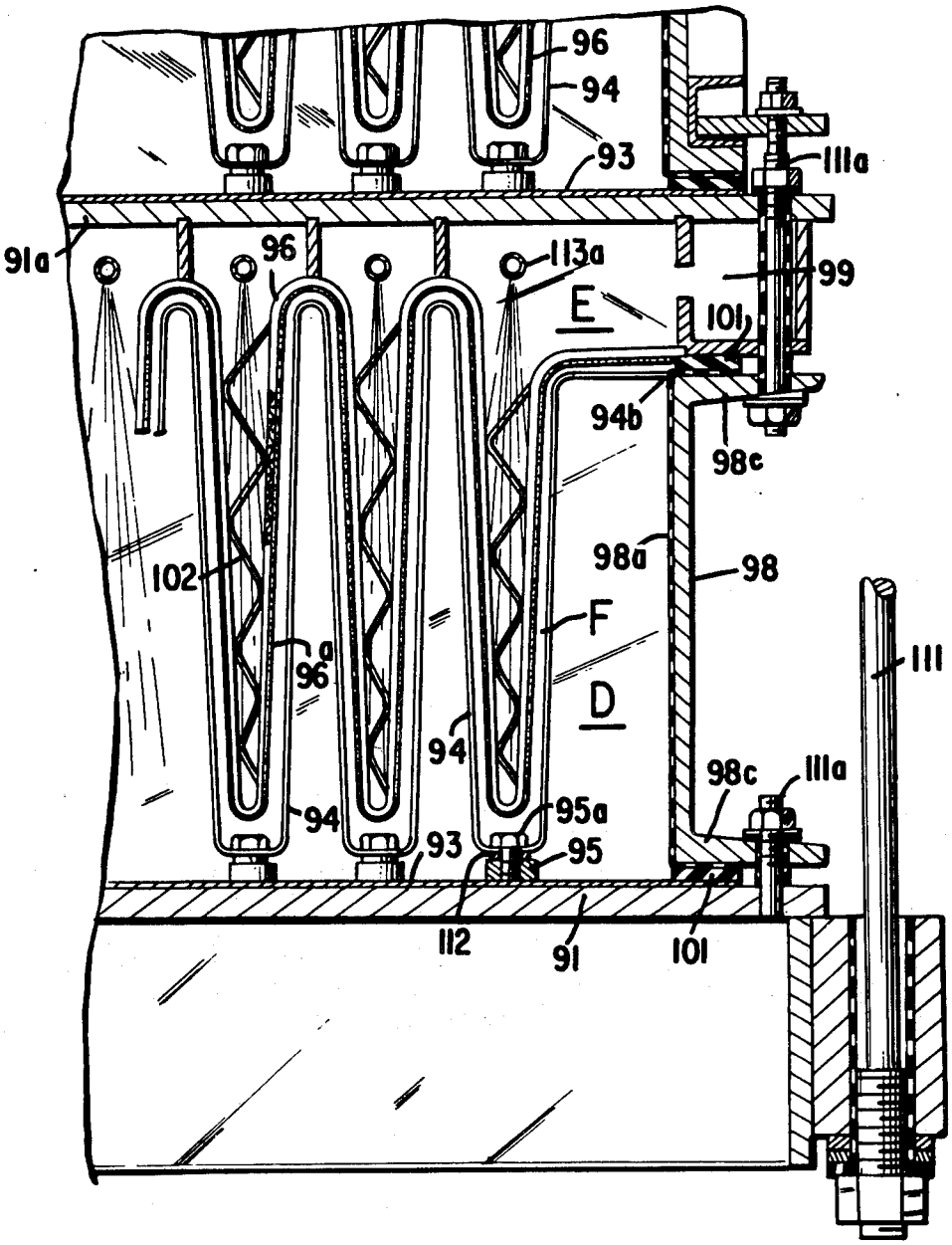
Figure 13:
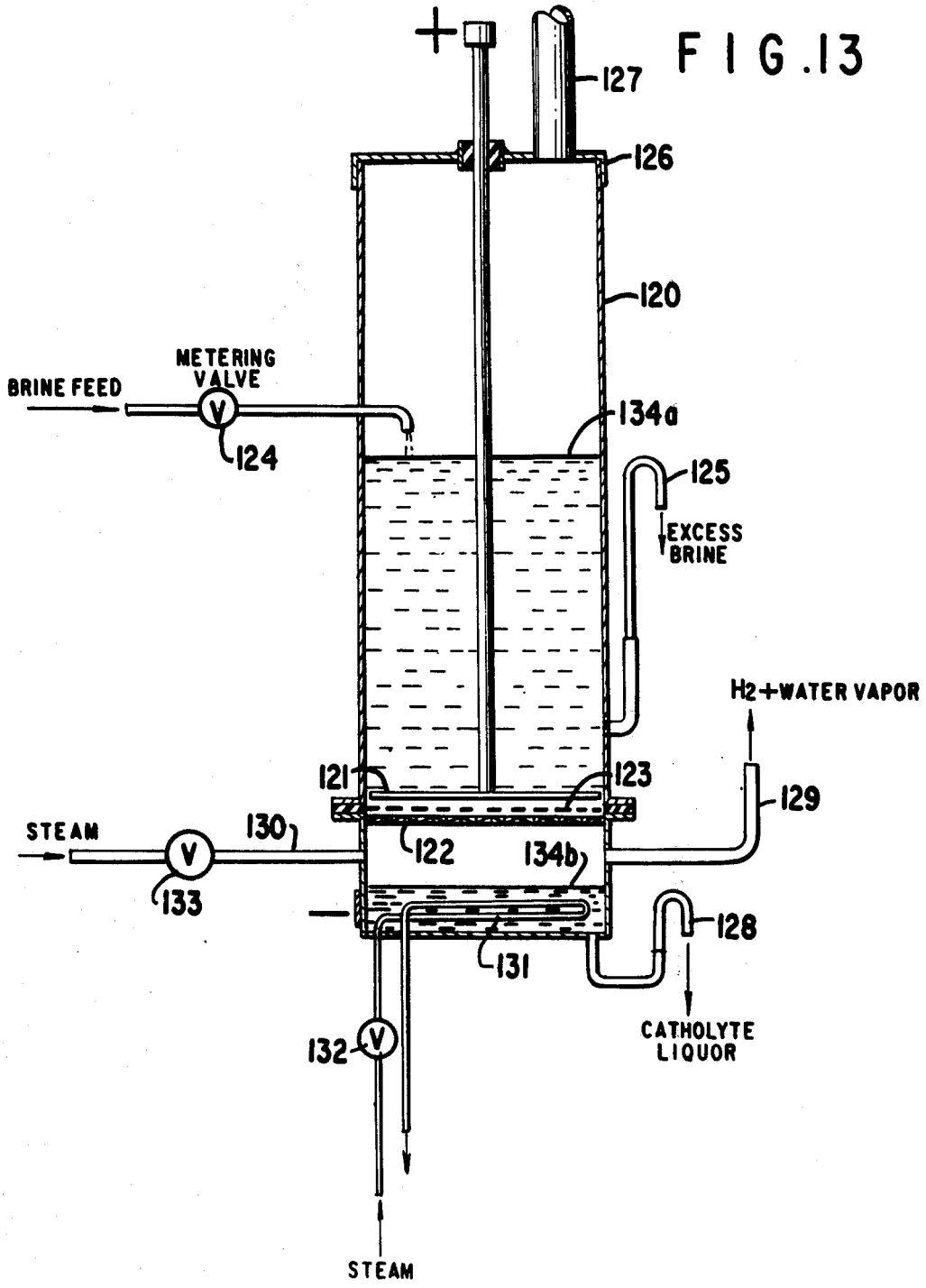

FIGS. 4 and 5 are detail cross section views of cathode gas and catholyte liquor discharge conduits, substantially along the lines 4 — 4 and 5 — 5 of FIG. 3;

FIG. 6 is a perspective view of a typical diaphragm cell with vertical anodes and cathodes, with parts broken away to show the interior construction;

FIG. 7 is a cross sectional view of the interior of the cell of FIG. 6;

FIG. 8 is a plan view, with parts broken away, of another form of diaphragm cell having anodes and cathodes in nested wave form;

FIG. 9 is a vertical, part-sectional view, with parts broken away, of the cell illustrated in FIG. 8;

FIG. 10 is a partial front view of the cell illustrated in FIGS. 8 and 9;

FIG. 11 is a cross sectional view approximately on the line 11 — 11 of FIG. 8;

FIG. 12 is a detail cross sectional plan view of the anode, cathode and diaphragm arrangement in the cell of FIG. 8; and FIG. 13 illustrates the cell used in Examples 1 and 2.

Figure 1:
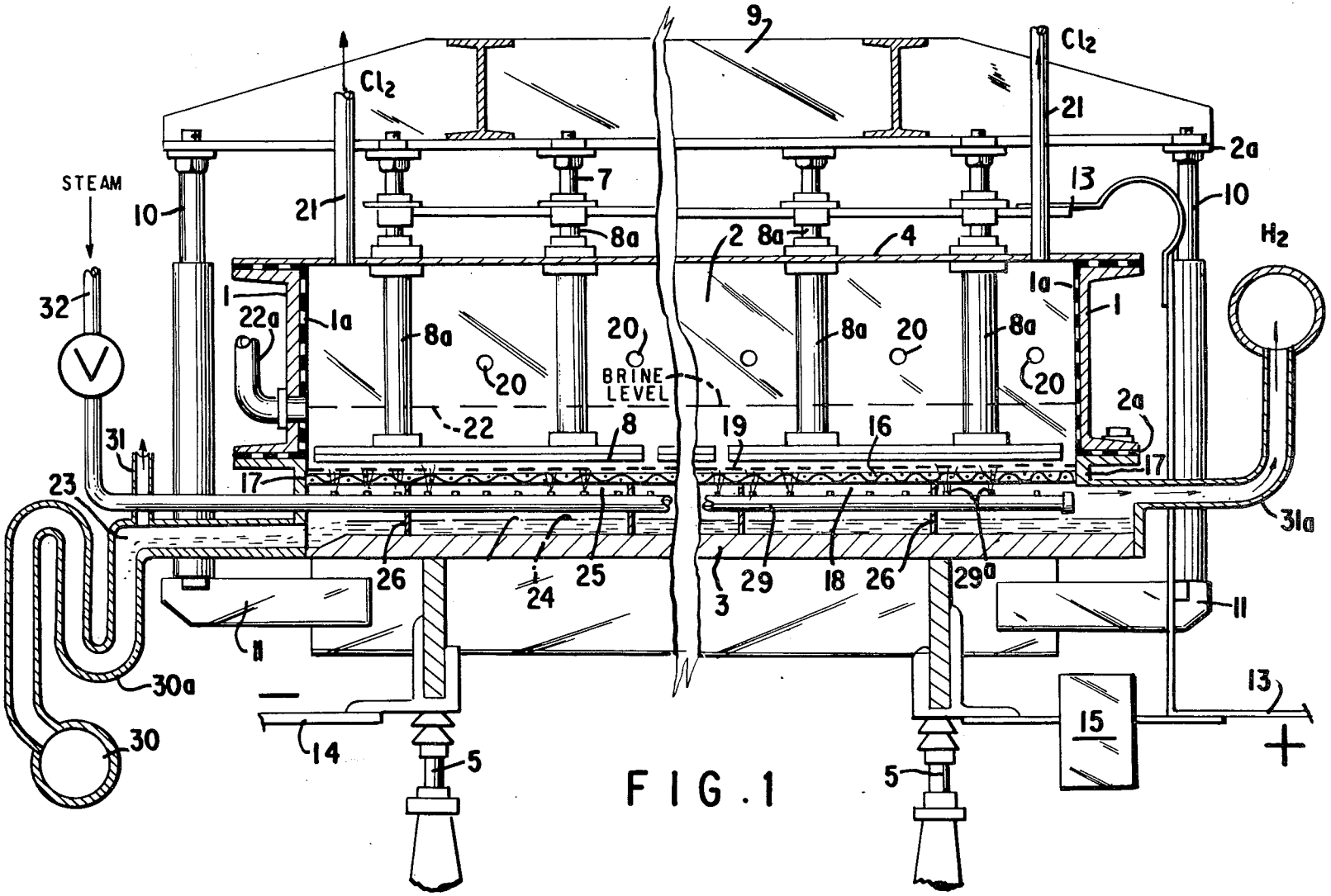
FIG. 1 is a cross sectional view of one form of horizontal, monopolar diaphragm electrolysis cell in which the methods of this invention may be practiced.

FIG. 1 illustrates a horizontal, monopolar diaphragm cell comprising side walls 1, end walls 2, bottom 3 and top 4 to form the cell enclosure. This type cell can be square, rectangular or, if desired, any other shape. The side walls 1 and 2 may be steel provided with an ebonite or other insulating layer 1*a* on the inside, or may be of a material which is non-corrosive with reference to anodic conditions, such as titanium, glass fiber reinforced polyester or the like. The bottom 3 and the side walls 17 of the cathode compartment are preferably of steel or other material which is not corroded under alkaline or cathodic conditions. The top 4 may be a steel plate provided with an ebonite or other protecting surface on the underside which is not corroded under acid or anodic conditions, or the top 4 may be a flexible sheet of rubber, neoprene or other non-corroding material. The cell is supported on adjustable insulating legs 5 by which the cell may be levelled or inclined as desired, and the top or anodic compartment is insulated from the bottom cathodic compartment by insulating gaskets 2*a*.

A number of substantially flat anodes 8 are suspended above the bottom of the cell, on adjustable anode supports or lead-ins 8*a* connected to anode supports 7, and are spaced from the cell bottom 3 to provide a cathode compartment 18 housing a cathode screen 16 and a diaphragm 19. The anodes 8 are preferably dimensionally stable anodes comprising a film forming metal base structure, such as titanium or tantalum provided with a coating of a conducting electrocatalytic material on their active surfaces, such as a coating of a platinum group metal or a coating containing a platinum group metal oxide or mixtures thereof.

The anodic structures may be supported by the cover of the cell itself, if the cover is of rigid material, or, as shown in FIG. 1, they may be supported by beams 9 which rest on adjustable legs 10 rigidly connected to the bottom of the cell, by means of supports 11 or by other means. The beams 9 may be used to lift the entire anode structure out of the cell trough for adjustment, repair or replacement. Insulation 2*a* prevents short circuiting between the anodic assembly and the bottom of the cell, and between the adjustable legs 10 and anode support beams 9. Electric current is fed to the cell by copper bus bars 13 which distribute the current to the several anodes 8 suspended over the cell bottom. Copper bus bars 14 connected to the bottom of the cell complete the electric connections to the individual cells. Normally, a number of cells are connected in series, and switches 15 permit a cell of the series to be shorted out of the circuit whenever this is necessary without interfering with the operation of the other cells of the series. The cathode screen 16, usually of steel or other metal is fixed or welded to the steel sides 17 of the cathode compartment 18 and a diaphragm 19 separates the anode compartment from the cathode compartment. Fresh brine is introduced into the cell through brine feed pipes 20, connected to a brine feed line at one end of the cell, and chlorine produced at the anodes flows out of the cell through the chlorine outlets 21, bubbling through the brine solution as it rises from the anodes into the chlorine chamber above the brine level 22. The brine may be introduced and the chlorine removed in other ways. When the diaphragm 19 is permeable, all brine flows through the diaphragm 19, which is supported on or above the screen cathode 16 and out of the cell box through the outlet 23 which also serves as the outlet for the sodium hydroxide which is mixed with the brine. Recirculation of the anolyte may be provided to maintain the temperature of the anolyte below the dew point of the water vapor in the cathodic compartment. This is accomplished by providing at least one anolyte outlet in the anodic compartment. This outlet is preferably an adjustable level overflow of the perk pipe type, such as 22a (FIG. 1), 47b (FIGS. 2 and 3) or 76a (FIG. 6) and similar outlets in the other cells illustrated. The anolyte discharged is fed back to the brine resaturation unit and the cool resaturated brine is recycled through the cell, in this way a high brine concentration in the anolyte is also maintained, if necessary heat exchange apparatus may be provided to maintain the resaturated brine fed into the cells at the desired temperature. Outlet 23 from the cathode is located so as to maintain the desired level of the catholyte in the bottom of the cell, as indicated by the catholyte level line 24, thus providing a gas space 25 in the cathode compartment above the catholyte level and below the diaphragm 19.

When diaphragm 19 is a non-permeable or slightly permeable permionic membrane, circulation of the anolyte must be provided to maintain the salt concentration and temperature at the desired level. Water in the form of steam is added to the cathode compartment to maintain the caustic contration and the temperature of the catholyte and cathode compartment at the desired level. The steam may be saturated, supersaturated or superheated.

The space above the brine level 22 in the anode compartment provides room for the release of anodic gas from the brine. The brine level may be raised or lowered to control the anolyte pressure on the diaphragm 19 when the diaphragm 19 is permeable. The anolyte pressure on the diaphragm may also be modified by modifying the pressure on the anodic gas. The diaphragm 19 may be asbestos, modified asbestos, reinforced asbestos cloth, sulfonated materials based upon a chemically-resistant highly cross-linked polymer backbone, such as a divinylbenzene-acrylic acid copolymer, polyethylene, divinylbenzene-polystyrene copolymers, polyvinyl-fluorocarbon ethers, or other suitable synthetic diaphragm material or any permionic selective membrane.

Contact strips 26 connected to the cell bottom 3 and to the screen cathodes 16 may run longitudinally or transversely of the cell and may be continuous or discontinuous, as necessary, to permit flow of the catholyte liquor to the catholyte outlet or outlets. Brine electrolyzed between the anodes 8 and the cathode screen 16 trickles through the diaphragm 19 and into the catholyte compartment when the diaphragm 19 is a permeable diaphragm and together with the sodium hydroxide formed at the cathode, flows out of one or more outlets 23 which may be in either the side walls or the end walls of the cathode compartment. The bottom of the cell may be inclined slightly to facilitate flow of the catholyte through the outlets 23, by adjusting the level of the legs 5.

When diaphragm 19 is a permionic membrane, the anolyte circulation is maintained on the anodic side, to maintain a constant brine concentration and a constant anolyte temperature below the dew point of the water vapor in the cathode compartment, while water condensed on the cathodic side drips into the bottom of the cathodic compartment together with the caustic formed, thus maintaining a low concentration of hydroxyl ion in the cathodic film wetting the diaphragm and providing and constantly renewing an aqueous ionic conducting layer between and contacting both the cathodic surface of the membrane and the cathode screen.

As the brine is electrolyzed between the anodes 8 and the cathode screens 16, a film containing sodium hydroxide is formed on the cathode side of the diaphragm and on the cathode, if the brine is sodium chloride, which film gets thicker and thicker until it drips into the bottom of the cathode compartment. In order to continually wash this film off the diaphragm, steam from the sparge pipes 29 connected to suitable steam headers 32, is condensed on the cathode side of the diaphragm. The number of sparge pipes 29 and of sparge openings 29a are sufficient to keep the cathode screens and the entire surface of the diaphragm flooded with steam and the anode compartment and anolyte are operated at a temperature sufficiently below the cathode compartment temperature to cause substantial condensation of the steam on the cathode side of the diaphragm, so that the aqueous film between the cathode screen and the cathode side of the diaphragm is continuously diluted and the excess liquid drips to the bottom of the cathode compartment where it flows out of the cell together with the depleted brine which has passed through the diaphragm. Steam may be applied to the cathode continuously or intermittently, at timed intervals by automatically controlled valves and may be sprayed on the cathode side of the diaphragm or introduced into the catholyte liquor, thus providing some evaporation of the catholyte liquor. As the depleted brine trickles through the diaphragms 19, it condenses the steam on the cathode side of the diaphragm 19 and the alkali metal hydroxide and depleted brine is discharged from the cell, so that the catholyte compartment at all times contains a low level of catholyte liquor. The pressure of the anolyte on the diaphragm 19 may be regulated to insure proper flow through the diaphragm, as the porosity of the diaphragm decreases in use due to plugging or other causes, by permitting the level of the anolyte liquor to rise or by increasing the pressure of chlorine gas.

Instead of introducing steam into the gas space above the catholyte liquor, the catholyte may be permitted to form a pool in the bottom of the cathode compartment and this pool may be heated by heat exchange between heating pipes immersed in the catholyte pool to evaporate water from the catholyte liquor and the anode compartment may be operated at a temperature below the cathode compartment to cause the cooler anolyte liquor to condense the steam in the top of the cathode chamber to continually wash the cathode side of the diaphragm and dilute the hydroxide film on the cathode side of the diaphragm, to keep the cathode side of the diaphragm free from the concentrated hydroxide layer. Water may be sprayed on the cathode screen in place of steam, but this further dilutes the catholyte and is not the preferred method of practicing this invention.

The catholyte liquor flowing through one or a plurality of outlets 23, flows into a collection pipe 30 and hydrogen or other cathode gases may be discharged through hydrogen outlets 31 which may be connected to the catholyte outlets 23 or, preferably, the hydrogen is discharged separate from the catholyte, through outlets 31a located toward the top of the catholyte compartment 18. Some of the water vapor provided in the cathode compartment may escape together with the hydrogen gas through the cathodic gas outlets and it is recovered by condensation outside the electrolysis cell.

Electrolysis current is distributed to the anodes 8 by positive copper bars 13 and anode lead-ins 8*a*. The current flows from the anodes 8 through the electrolyte to the cathode screen 16, which is connected to the cell bottom 3 by the contact strips 26 and by welding to the top of the cathode sides 17. The interelectrodic gap may vary between 2.5 and 6.0 mm. The current flows through contact strips 26, side walls and the bottom of the cathode compartment and to the negative copper bus bars 14. In the electrolysis of sodium chloride, chlorine is released at the anodes 8 and sodium hydroxide is formed at the cathode screen 16.

FIGS. 2 to 5 illustrate the principles of this invention applied to a stacked, bipolar diaphragm cell, in which the cell comprises a plurality of stacked bipolar elements in a cell stack S which may consist of fifty or more individual cell units of similar construction, of which only two complete units are shown. Each unit is formed by a rectangular steel frame 33, having top and bottom flanges 33*a* and 33*b* in which each lower flange 33*b* rests upon the upper flange 33*a* of the next lower unit, insulating gaskets 34 being provided between the units to form a liquid tight seal.

Figure 2:
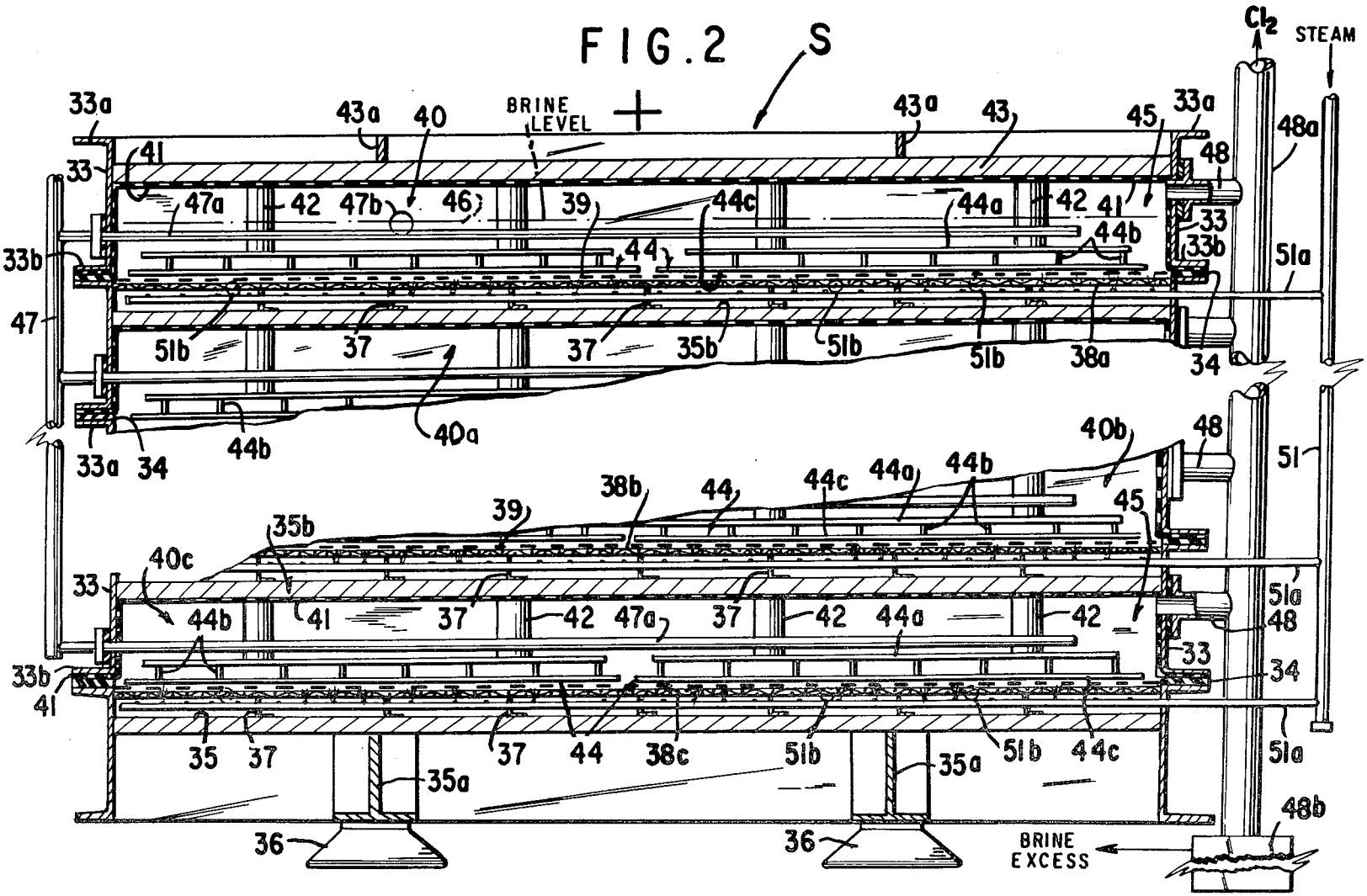
FIG. 2 is a vertical cross section of a stacked bipolar electrolysis cell designed for the practice of this invention, substantially along the line 2 — 2 of FIG. 3.

Each frame 33 houses a cathode section in one portion of the frame and an anode section in the other portion, so that when the frames are assembled as shown in FIG. 2 the anode section of one frame is above the cathode section of the next lower frame. The construction of the top frame and bottom differ slightly from the intermediate frames as shown in FIG. 2. The bottom frame 33 has a rectangular flat steel sheet 35 welded or otherwise secured in good electrical connection in the frame approximately one-third the distance from the top of the frame, forming the bottom plate of the cell stack. The bottom plate 35 has reinforcing ribs 35*a* extending from side to side of the plate 35 and rests on insulating supports 36. The bottom frame 33, the bottom plate 35 and the reinforcing ribs 35*a* are welded together into an integral structure and the negative bus bars (not shown) are connected to the bottom plate 35. Similar bottom plates 35*b* are shown for the upper cell units of the cell stack S. While the cell stack S will be described as substantially horizontal, it will be understood that the cells are sloped 1° or 2° from the horizontal, to provide better drainage of catholyte or other liquid from the cell units.

A plurality of angle iron cathode screen support bars 37 are welded or otherwise secured to the top of plates 35 and 35*b* and to similar bottom plates 35*b*, and the cathode screens 38*a*, 38*b*, 38*c*, etc. are welded to the top edges of the frames 33 and tack welded to the tops of the angle iron supports 37. The cathode screens 38*a*, 38*b*, 38*c*, etc. are covered with diaphragms 39 which may be asbestos fiber, paper or cloth or synthetic membrane material. The space between the diaphragms 39 and the bottom plates 35, 35*b*, etc. and the surrounding walls of the rectangular frames 33 constitute the cathode compartments of the cell stack.

The anode compartments are in the lower (approximately) two-thirds of the next upper frames 33 and are shaped like inverted boxes 40, 40*a*, 40*b*, 40*c*. The anode boxes 40, 40*a*, 40*b*, etc. are lined with a material which is resistant to the cell conditions. The linings 41 may be titanium, tantalum, hard rubber or plastic which will protect the sides and tops of the inverted anode boxes from the corrosive effect of brine and anodic gases. The linings 41 are extended under the bottom flanges 33*b* of the frames 33, as indicated at 41, and rest upon insulating gaskets 34, so that the anode compartments are fully insulated from the cathod compartments.

Anode supports or lead-ins 42 are connected to the bottom plates 35*b* of the preceding cathode compartments to support anodes 44 within the anode boxes or compartments, through primary conductor bars 44*a*, connected to secondary conductor bars 44*b*, running at right angles to primary conductor bars 44*a*. The secondary conductor bars 44*b* are connected to the anode working faces 44*c* of the anodes which may be in screen, mesh, rod or other open forms having from approximately 30% to 60% voids, so that gas released at the anodes may readily pass upward through the anodes and the electrolyte and into the anodic gas release space 45 above the the electrolyte level 46 in each anode compartment. The anode structures 44, 44*a*, 44*b*, and 44*c* are made of a valve metal such as titanium or tantalum or alloys thereof and the primary and secondary conductor bars and working faces are preferably welded together. The anode supports or lead-ins 42 may be titanium clad copper or any other electrically conductive material, suitably insulated or protected from the corrosive conditions of the anodic compartments. The anode lead-ins 42 may be screw threaded into the cathode bottom plates 35 or otherwise adjustably secured thereto, to permit adjustment of the interelectrodic gap between the anode and cathodes. The anode working faces 44*c* are formed of thin sheets (approximately 0.5 to 1.5 mm) of a valve metal, spaced about 4 to 10 mm above the cathode screens. They are usually of open mesh titanium in reticulate, screen, rod or other open mesh form, and are coated with an electrically conducting electrocatalytic coating of one or more oxides of platinum group metals together with other protective oxides such as oxides of titanium or with a coating of platinum group metals in metallic form.

When titanium or tantalum is used to form the linings 41 of the anode compartments 40, 40*a*, 40*b*, etc., these linings may be welded or otherwise electrically connected to the preceding cathode bottom plates 35, the linings may then act as back plates for the anode structures 44, 44*a*, 44*b*, etc and the anode structures may be electrically connected to the back plates. Intermediate metals such as copper, lead and the like may be used to sandwich weld the titanium linings 41 to the plates 35*b*. Friction welds may be used between the titanium, copper and steel parts.

The top plate 43 is welded into the top frame 33 and is provided with reinforcing ribs 43*a* and the positive bus bars (not shown) are connected to the top plate 43. The cells operate as bipolar cells with current flowing through the top plate 43 and through all the cells in the stack to the bottom plate 35.

Brine is introduced into each anode compartment from brine feed lines 47 through branch lines 47*a* in the amount necessary to maintain the desired brine level 46 in each anode compartment and maintain flow through the diaphragms, the brine level being increased as the porosity of the diaphragms decreases. Adjustable brine recirculation outlets 47*b* may be provided in each cell unit, as shown in the top unit in FIGS. 2 and 3.

In the electrolysis of sodium chloride brine, chlorine gas flows into the gas release space at the top of each anode compartment and flows out of each anode compartment through chlorine outlets 48 into chlorine headers 48*a* and to the chlorine recovery system. The anodic gas release space at the top of each anode compartment facilitates separation of the gas from the electrolyte and produces less foaming of the electrolyte than when no separate gas release space is provided. Any brine in the chlorine flowing through the outlets 48 is recovered in a trap 48*b* and returned for resaturation. Hydrogen released at the cathode escapes from the top of the cathode compartments through outlets 49 (FIG. 4) to the hydrogen recovery line 49*a* and sodium hydroxide also formed at the cathode drips down from the cathode screens 38*a*, 38*b*, etc. to the bottom of the cathode compartments and flows from the bottom of the cathode compartment through outlets 50 (FIG. 5), preferably located on the side of the cell opposite the $Cl_2$ and $H_2$ outlets, and into the sodium hydroxide recovery line 50*a*. The cell is sloped about 1 to 2° toward the sodium hydroxide outlets 50. The provision of a hydrogen release chamber above the sodium hydroxide level in the cathode compartments facilitates the hydrogen separation from the catholyte liquor and the washing of the cathode screens as described below.

In order to reduce the build-up of concentrated sodium hydroxide films on the cathode side of the diaphragms, steam is introduced into the space below the cathode screens 38*a*, 38*b*, etc., by means of a steam header line 51 provided with branch lines 51*a* with sparge openings 51*b*, which distribute the steam uniformly over the cathode screens. The rising steam encounters the cooler anolyte liquor percolating through the diaphragms 39 and is immediately condensed, washing the cathode screens with steam and hot water which keeps the sodium or other alkali metal hydroxide film on the cathode side of the diaphragms at a minimum thickness and promotes conductivity between the cathodes and the electrolyte. The steam may be applied to the cathodes continuously or intermittently by means of the time operated control valves in the steam lines to regulate the washing of the cathodes, as desired. The temperature of the anolyte liquor percolating through the diaphragms is kept below the temperature of the cathode compartment by cooling the anolyte feed liquor, as desired.

Similar results can be secured by heating the catholyte liquor in the bottom of the cathode compartments, by means of immersed steam pipes or other heat exchange means to cause steam to be formed in the catholyte compartments, which rises and is condensed on the cathode side of the diaphragms similar to a reflux condenser operation. Heating the catholyte liquor is preferred when the cell is equipped with a porous diaphragm since it offers the additional advantage of increasing the caustic concentration in the catholyte liquor as part of the evaporated water is discharged together with the hydrogen through the gas outlets of the cathodic compartment. Steam distribution pipes and sparge openings to spread the steam are not always necessary and it is sufficient, with many electrolysis cell designs, to merely introduce steam into the cathode compartments where it automatically fills these compartments and is condensed over the entire area of the cathode side of the diaphragms. Saturated, supersaturated or superheated steam may be used, if desired.

The cell stack of FIGS. 2 to 5 is kept in fluid tight relation by the gaskets 34 between each of the frames and by the weight of the frames and of the electrolyte therein. However, clamps between each frame member or tie rods may be used to hold the cell stack together.

In horizontal cells with non-porous permionic diaphragms, steam condensation or other introduction of water on the cathode side of the diaphragms is essential, otherwise substantially no liquid is present on the cathode side of the diaphragms and the conductivity in the cathode compartment is practically nil.

The cell illustrated in FIGS. 6 and 7 is intended to show the application of this invention to a typical diaphragm cell with vertical or substantially vertical anodes and cathodes.

The cell structure shown in these drawings comprises the cell can 61 having outer side walls 62 and inner side walls 63 of electrically conductive meterial. The outer side walls 62 with inner walls 63 form the peripheral hollow chamber 65 which surrounds the cell can 61 and serves for the collection of catholyte solution and cathode gas released in cathode tubes 66 and half-cathodes 67. Side walls 63 are protected where necessary by halogen-resistant material. The outer side walls are usually of steel and are connected to a source of electricity by the negative bus bar 68 which surrounds the outer walls 62. The inner side walls 63 are usually of screen, reticulate metal or other conductive material which permits passage of gas and liquor therethrough. The catholyte solution and cathode gas enter the hollow chamber 65 from the interior of the cathodes 66.

The anodes 69 are preferably dimensionally stable metal anodes of a film forming metal, resistant to anodic cell conditions, such as titanium or other valve metals and are provided with an electrically conductive electrocatalytic coating containing a platinum group metal or an oxide of a platinum group metal. The anodes mounted on the base member 70 by means of upright current lead-in connectors 71 electrically connected to the cell base 70, which is provided with positive bus bar connections 72. The cell top 73 is usually of plastic material and rests on the top of the cell can 61 in a fluid-tight manner. The hollow wall cell can 61 carrying the cathode tubes 66 fits over the surrounds the anodes 69. A rubber or neoprene blanket 82 on the base 70, is provided with a raised lip 83 which surrounds the cell can 61, providing a fluid-tight seal and preventing leakage from the cell can. Brine is fed to the cell through one or more brine feed inlets 74 and, in operation, chlorine released at the anodes is discharged from the anode compartments through chlorine outlets 75, hydrogen and other gases are discharged from the cathode compartment of the cell through hydrogen outlets 76, caustic is discharged through an adjustable catholyte outlet 77 and brine to be recirculated is removed through adjustable brine outlet 76*a*, preferably of the adjustable gooseneck type. This type cell, with graphite anodes, is described in greater detail in U.S. Pat. Nos. 2,987,462 and 3,491,041. Graphite anodes may be used in the cells of FIGS. 6 and 7 if desired.

The hollow elongated oval tubes 66 forming the cathodes extend from side to side of the cell can 61 and from one inner side wall to the other inner side wall 63 of the hollow side wall chamber 65. The tubes 66 and inner walls of the chamber 65 are covered with a diaphragm material 78 which may be asbestos, modified asbestos, or a permionic membrane material. In the operation of the cell of FIGS. 6 and 7, according to the principles of this invention, the catholyte liquor in the cathode tubes 66 and the peripheral chamber 65 is kept at a low level indicated approximatly by the catholyte level 79 in FIGS. 6 and 7, and the anolyte level 80 may be at any desired level above the top of the cathodes 66 and anodes 69. During operation, steam is injected on the cathode side of the diaphragms into the top of the cathode tubes 66 by means of steam pipes 81 or in other ways, where it is condensed by the cooler anolyte liquor on the other side of the diaphragms and flows down the walls of the cathode tubes and into the pool of catholyte liquor at the bottom of the cathode tubes 66, from which a concentrated catholyte liquor is removed through the adjustable overflow tube 77. The operation is similar to the operation of the process and apparatus of FIGS. 1 to 5.

The cell shown in FIGS. 8 to 12 is intended to illustrate the use of this invention in a bipolar cell with vertical anodes and cathodes in nested wave form.

FIG. 8 illustrates a three unit bipolar cell having a terminal positive end unit A, an intermediate unit B and a terminal negative end unit C. Only one intermediate unit B has been illustrated, but it will be understood that any number of intermediate units B, B, etc., may be used. The unit A consists of a positive (anode) end plate 91, preferably of steel, to which the positive electrical connections 92 are secured. The plate 91 is provided with a titanium, tantalum or other valve metal lining 93 which is resistant to the electrolyte and the electrolysis conditions encountered in the cell and titanium mesh anode waves or fingers 94 with open or closed ends are connected to the titanium lining by titanium connectors 95, illustrated in greater detail in FIG. 12, and described in detail below, which insure good electrical connections between the end plate 91 and the anove waves or fingers 94. The titanium or other valve metal lining 93 is secured to the end plate 91 by sandwich welding, using intermiate sandwich metals, such as copper, lead, etc., if necessary, or by bolting or any other connection which insures a good metal to metal electrical contact between the end plate 91 and the electrolyte resistant lining 93. Titanium, tantalum or other valve metals or alloys of these metals may be used for the lining 93 and the anode waves or fingers 94. The anode waves 94 are formed from open mesh titanium, tantalum or other valve metal. The titanium or other valve metal anodes are provided with an electrically conducting electrocatalytic coating of a platinum group metal or a mixture of oxides of a valve metal and a platinum group metal. The mixed oxide coatings may be applied as a solution of the desired ingredients, in the form of paint, spray or the like and baked on the anodes. The coatings may be applied to the front (facing cathode) or back of the anodes or to both the front and back, or may be applied to only a portion of the anode faces.

The end anode plate 91 is spaced from a steel cathode supporting end plate **91*a* from which the steel screen cathode waves or fingers 96 are supported by welded strips or projections 97 which form the electrical connection between the cathode fingers and the steel plate 91*a*. Each cathode supporting end plate 91*a* (except the negative terminal end plate) is provided on the anodic side with a valve metal lining 93, as shown in FIGS. 8, 9 and 12, to form a bimetallic partition between each of the bipolar cell units. A spacer frame 98 forming the side walls of each cell unit extends between the lining 93 and the catholyte liquid and gas outlet trough 99 of the next adjacent cathode compartment. The catholyte outlet trough 99 surrounds the catholyte compartment 100 formed between the inside of the cathode fingers 96 and the plate 91*a*. A catholyte outlet pipe 99*a* connects the trough 99 with an adjustable telescoping pipe 99*b* through which the catholyte is discharged. The spacers 98 are lined with a titanium or other valve metal lining 98*a* or a plastic lining which is resistant to the anolyte and the corrosive conditions encountered in the anolyte compartment of an electrolytic cell. The end anode waves 94 are connected to the linings 98*a* as indicated at 94*b* (FIGS. 8 and 12). Alternatively, the end anode waves 94 may project into the space between the flanges 98*c* of the spacers 98 and the gaskets 101. Rubber gaskets 101 seal the joints between the plates 91 and the catholyte and gas outlet trough 99 attached to the plates 91*a* and the flanges 98*c* of the spacers 98, so that a fluid-tight box-like structure housing the anode waves 94 and the cathode waves 96 is formed between the plates 91 and 91*a* in each of units A, B and C of the bipolar cell. Inside each cathode finger 96, zigzag bent steel reinforcements 102 are welded at spaced intervals to prevent collapse of the screen cathode waves or fingers 96 when an asbestos or other diaphragm material is deposited on the screen cathode fingers under vacuum. The steel screen cathode waves or fingers 96 are closed at the top and bottom as illustrated in FIG. 11 and are covered with a diaphragm material 96*a* (FIG. 12**), usually either woven asbestos fiber, asbestos flock applied under vacuum, modified asbestos or permionic membrane material.

The diaphragm material covers the sidewalls as well as the top and bottom of cathode waves or fingers 96. The diaphragms **96*a* on the cathode waves are only partially and diagrammatically shown in FIG. 12, but it will be understood that the cathode waves are completely covered with diaphragms when in use in the cells. The diaphragms separate the anolyte compartments D and the catholyte compartments E (FIG. 8**) and keep the gases and liquids in each of these ompartments separate.

The brine or electrolyte is fed into the cell and flows through the diaphragms **96*a*** into the catholyte compartments E and the gases and liquids in the anolyte and catholyte compartments are separately recovered as described below.

When the cell illustrated in FIGS. 8 to 12 is in use, the electrolyzing current flows through the electrolyte in the interelectrodic gap F from the anode waves 94 to the cathode waves 96. Anodic gases are released at the anode waves or fingers 94 and rise through the electrolyte at both the front and back of the anode waves, if the diaphragms are porous or water absorbent, the electrolyte or brine flows through the diaphragms surrounding the cathode waves 96 and the cathodic gases and liquids formed at the cathode side of the diaphragms are discharged from the cathodic compartments through the outlets **99*a*. The anodic gases are discharged through the outlets 103 into the brine containers 104**.

When used for the production of chlorine and caustic soda from sodium chloride brine, chlorine released at the anodes 94 rises through the anolyte and escapes through the chlorine outlet pipe **103*a* to the chlorine recovery system. Saturated brine flows into brine container 104 through pipe connections 106 and feed branches 106*a*, shown in dash lines in FIG. 10, into the anolyte compartments D. The anolyte level is maintained above the top of the anodes as indicated by the anolyte level line 105**. The feed brine is fed into the lowest part of the anolyte compartment, so that the flow of saturated brine in the interelectrodic gap is from the bottom upward.

Brine is fed continuously or as needed from the saturated brine system into the brine containers 104 and a sight glass **104*a* (FIG. 10) indicates the level of the brine in the brine container 104. The space between the anodes and cathodes is continuous from side to side of spacers 98 of each cell unit as illustrated in FIGS. 8 to 12, so that the saturated brine flows into the interelectrodic gap F between the anodes 94 and cathodes 96** and completely fills this space.

Sodium hydroxide released at the cathode fingers flows into the bottom of the catholyte space E behind the cathode diaphragms surrounding the cathode fingers 96 and into a catholyte outlet. The hydrogen flows upward to the top of the catholyte compartment and out through the hydrogen outlets 107 and the sodium hydroxide flows to the catholyte outlet 99*a*. An electrolyte drain 108 permits the catholyte compartment, as well as the anolyte compartment and the interelectrodic gap space of each cell unit, to be drained. A telescoping pipe connection 99*b* (FIG. 10) communicating with the catholyte outlet 99*a* is adjustable to control the level of the catholyte in the catholyte compartments E, so that the catholyte level may be maintained as low as desired. The approximate catholyte level is shown at 99*c*. The telescoping drain pipe 99*b* can be adjusted by moving the upper section upwardly on the lower section to adjust the overflow height or by rotation around a pivoted joint 99*d* on the catholyte outlet pipe 99*a*, so that the level of the catholyte in the compartment E may be maintained as desired, a practice which is well known in the electrolysis cell art. In place of the telescoping pipes, the usual inverted U-shaped perk tube may be used to control the catholyte level in the compartments E.

The cell units A, B, B, B and C are mounted on I-beam supports 109 (FIG. 10), supported on insulators 109*a*. Syenite plates 110 are cemented to the upper faces of the I-beams 109 insulate the titanium lined boxes of the cell units A, B and C from the metal I-beams and permit the heavy elements of the cell units to slide on the syenite plates 110 without too great friction during assembly or disassembly of the units. The sides 98 and the ends 91 and 91*a* are held together by tie rods 111, suitably insulated from their surrounding parts by means of insulating bushings. The temporary bolts 111*a* shown in FIG. 12 are used only during assembly of the electrolyzer, to tighten the units together and are taken off before start of the cell in order to avoid short circuits. During operation of the cell, the tie rods 111 hold the terminal end plates 91 and 91*a* and the side spacers 98, forming the electrolyte box of each cell unit, together. The tie rods 111 extend from the positive terminal end plate 91 of unit A to the negative terminal end plate 91*a* of the terminal unit C, regardless of the number of intermediate units B in the bipolar cell assembly.

The current flows consecutively from the positive terminal 92 through the end unit A, through the intermediate units B, which may vary in number from one to twenty or more, and through the terminal unit C to the negative terminal 92*a* of the circuit.

The anodes 94 and cathodes 96 are preferably formed as uniform waves or fingers nested together and uniformly spaced apart, as illustrated in FIGS. 8 to 12, to provide a substantially uniform electrode gap between the anodic surfaces and the cathodic surfaces. The anodes waves 94 and cathode waves 96 need not be as long or deep as illustrated. Shallower waves may be used, but the deeper waves illustrated provide greater anode and cathode surfaces within cell units of the same square area than shallower waves would provide. Flat planar anodes and cathodes could be used, but would not provide as large an area as the wave form.

As illustrated in FIG. 12, the anode waves 94 are connected to the titanium lining plate 93 by titanium or other cylinders 95 welded to the plate 93. The cylinders 95 are screw threaded on the inside and titanium bolts 95*a* (FIG. 12) are used to connect the anode waves 94 to the cylinders 95 and plate 93, using titanium strips 112. The steel cathode waves 96 are connected to the plates 91*a* by steel strips 97 welded to the plates 91*a* and to the trough of the waves 96. The cathode waves are entirely covered with a diaphragm material, such as woven ashestos, asbestos fibers, permionic membranes, or the like, partially illustrated at 96*a* in FIG. 12. Titanium strips 112 distribute the current to the anode waves 94. The anodes waves 94 may be solid titanium sheet, perforated titanium sheet, slitted, reticulated titanium plates, titanium mesh, rolled titanium mesh, woven titanium wire or screen horizontally or vertically arranged titanium rods or bars or similar tantalum and other valve metal plates and shapes or alloys of titanium or other valve metals or any other conductive form of titanium, and the waves 94 are provided with a conductive electrocatalytic coating capable of preventing the titanium from becoming passivated and, when used for chlorine production, are capable of catalyzing discharge of chloride ions from the surfaces of the anodes. The coating may be on either one or both faces of the anode waves and is preferably on the face of the anode waves 94 facing the cathodes 96.

In the practice of this invention in cells of the type illustrated in FIGS. 8 to 12, the anolyte compartments are kept at a lower temperature than the catholyte compartments, by circulation of the anolyte, or by cooling and circulation, the anolyte level is maintained above the top of the anodes as indicated by the anolyte level line 105 and the catholyte level is maintained low, as indicated by the line 99*c*. Steam is continuously, or intermittently, introduced into the catholyte compartments E behind the diaphragms 96*a* by means of steam pipes 113 fed by steam header pipes 114. Spreader pipes 113*a* (FIGS. 8 to 12) provided with sparge openings may be used to distribute steam from the top to the bottom of the cathode waves, but usually it is sufficient to merely introduce the steam into the top of the cathode compartments. Part of the steam escapes with the hydrogen through hydrogen outlets 107, but most of the steam is immediately condensed on the cathode side of the diaphragms, where it flows down the cathode screens, washing the caustic film from the cathode screens and the cathode side of the diaphragms, and providing greater current efficiency for the electrolysis process. The caustic concentration in the bottom of the cathode compartments may be controlled by maintaining the level of the catholyte as low as desired and by controlling the amount of steam introduced.

Instead of blowing steam into the cathode compartments, behind the diaphragms and above the catholyte level, steam may be introduced into the catholyte liquor to evaporate a portion of the catholyte liquor and the vapors rising from the catholyte liquor will be condensed on the cathode side of the diaphragms by the cooler anolyte liquor on the anode side of the diaphragms. This action is somewhat similar to the reflux condensing, and provides water to wash the cathode screens. Similar results may be obtained by heating the catholyte liquor to a temperature above the anolyte temperature by means of indirect heat exchanger pipes immersed in the catholyte liquor in the bottom of the cathode compartments to vaporize water from the catholyte liquor. This latter technique is to be preferred in cells equipped with porous diaphragms. When this technique is used in cells equipped with permionic membranes impermeable to water, a certain amount of water is introduced into the cathodic compartment before start-up. Make-up water is then continuously of intermittently fed into the cathodic compartment to replace the catholyte liquor recovered from the cell and the water vapor lost through the hydrogen outlets in order to maintain a constant liquid level and a constant caustic concentration in the catholyte pool.

Permionic membranes which may be used in the practice of this invention are sold by E. I. Du Pont de Nemours & Co., Inc., Wilmington, Del., U.S.A., under the trade name XR perfluorosulfonic Acid Membranes. These membranes are described in U.S. Pat. No. 3,282,275 and British Pat. No. 1,184,321. Membranes of this type have a water absorption of about 18% to 38% when measured by ASTM-D570 standard testing procedures. Permionic membranes manufactured by Asahi Glass Co. of Tokyo, Japan and sold under the name "Selemion CMV" may also be used.

Further details of construction of the type of electrolysis cell illustrated in FIGS. 8 to 12 are shown and described in British Pat. No. 1,345,254.

When substantially non-water-porous, non-water-absorbent permionic membranes are used as diaphragms, the steam condensation on the cathode side of the diaphragms is essential to provide the necessary catholyte liquid layer contacting the cathodic side of the membrane and the metal cathode screen and capable of conducting the ionic current, in this way the present invention permits the use of fluid impermeable permionic membranes in horizontal diaphragm cells.

In these cells, attempts to substitute fluid impermeable permionic membrances for porous diaphragms heretofore used have failed because of the difficulty of insuring uniform wetting of the cathode screen by the catholyte. Even with completely flooded cathode compartments, the hydrogen gas pockets against the membrane breaking the liquid bridging between the latter and the cathode and resulting in an erratic performance of the cell or in a complete stoppage of the electrolysis current.

This obstacle is overcome by the present invention.

FIG. 13 illustrates a cell used to demonstrate the operation of this invention according to the following Examples 1 and 2. In this embodiment, the cell casing 120 houses an anode 121, a cathode grid 122 and a diaphragm 123. Brine is fed into the anode compartment through a metering valve 124 and a constant anolyte level is maintained in the anolyte compartment by an adjustable gooseneck 125, which allows any excess brine to flow through it. The anode 121 is suspended from the cell casing cover 126 which is provided with a chlorine outlet 127. Positive and negative electrical connections are provided as indicated. The cathode compartment is provided with an adjustable gooseneck discharge pipe 128 and a gas outlet 129 for hydrogen and water vapor. A steam inlet pipe 130 controlled by valve 133 permits steam to be introduced into the cathode compartment and heating coils 131 controlled by valve 132 are immersed in the catholyte liquor. The level of the anolyte and catholyte liquor is indicated by the lines **134*a* and 134*b***.

The feed brine used in the following examples had a concentration of 310 gpl - NaCl and contained the following impurities CA < 0.5 ppm, Mg < 1 - 2 ppm, $SO_4$ < 200 ppm and no chromium.

EXAMPLE 1

The cell of FIG. 13 was equipped with an asbestos paper diaphragm having a thickness of 1.2 mm in dry condition.

Brine was fed into the anodic compartment and the gooseneck discharge pipe 125 was adjusted to maintain a constant hydrostatic head on the diaphragm.

Catholyte liquor, percolating through the porous diaphragm 123, collected on the bottom of the cathodic compartment and was recovered through the gooseneck discharge pipe 128.

A first run of about twelve hours was conducted under traditional conditions, that is, no heat was supplied to the catholyte liquor pool in the cathodic compartment and no water vapor was introduced into the cathodic compartment.

The operation parameters and efficiency of the electrolysis process are reported in Table 1 under run No. 1. The efficiency was calculated by measuring the amount of caustic produced per unit time.

At the end of the above run and while maintaining constant all the other operating conditions, steam was circulated into the heating coil 131 and its flow was regulated until the monitored temperature of the catholyte in the pool on the bottom of the cathodic compartment was increased to and stabilized at about 102° C, as measured by a thermometer immersed in the liquid. No additional water vapor was supplied into the cathodic compartment from external sources. After several hours of operation, the operation parameters of the electrolysis process were recorded. :

As can be seen from the data reported in Table 1, under run No. 2, the heating of the catholyte liquor resulted in a marked improvement of the cathodic efficiency and NaOH concentration and in a lower chlorate concentration in the catholyte liquor.

At the end of run No. 2, cooler brine was fed into the cell, its temperature was reduced from 55° C, as in the preceding runs 1 and 2, to 30° C to provide a cooler diaphragm surface to enhance condensation of the water vapor generated in the cathodic compartment. Also, the liquid head over the diaphragm was lowered from 25 cm to 20 cm to decrease the rate of percolation of the anolyte through the diaphragm. The temperature of the anolyte as measured by a thermometer immersed therein decreased from 87° C to 67° C and the supply of steam through the heating coil was slightly increased, resulting in a catholyte liquor temperature of 108° C as measured by a thermometer immersed in the catholyte pool.

A further improvement of the cathodic efficiency and of the caustic concentration was experienced and the chlorate concentration in the catholyte liquor decreased as reported in Table 1 under run No. 3.

EXAMPLE 1

TABLE 1

| Type of diaphragm | | Porous asbestos paper | | |
|---|---|---|---|---|
| Run number | | 1 | 2 | 3 |
| Hydrostatic head on anolyte side of diaphragm | cm. | 25 | 25 | 20 |
| Feed brine concentration | gpl | 310 | 310 | 310 |
| Feed brine temperature | °C | 55 | 55 | 30 |

TABLE 1-continued

| Type of diaphragm | | Porous asbestos paper | | |
|---|---|---|---|---|
| Run number | | 1 | 2 | 3 |
| Average anolyte concentration | gpl | 220 | 215 | 210 |
| pH of anolyte | | 4.5 | 4.5 | 4.5 |
| Anolyte temperature | ° C | 84 | 87 | 67 |
| Current density | A/sq. dm. | 50 | 50 | 50 |
| Cell voltage measured at electrodes | Volts | 3.45 | 3.4 | 3.5 |
| Catholyte temperature in cathodic compartment | ° C | 85 | 102 | 108 |
| Catholyte concentration: | | | | |
| NaOH | gpl | 210 | 214 | 265 |
| NaCl | gpl | 145 | 140 | 120 |
| Chlorates | gpl | 3.5 to 4.5 | 2 | 0.5 |
| Cathodic current efficiency | % | 68 | 84 | 90 |

EXAMPLE 2

The asbestos diaphragm used in runs 1, 2 and 3 was substituted by the permionic membrane "Selemion CMV", made by Asahi Glass Co., Tokyo, Japan, in the cell of FIG. 13.

A preliminary permeability test was conducted maintaining an anolyte level of 20 cm in the anodic compartment for about an hour. No brine filtered through the membrane and the cathode remained dry, preventing any electrolysis current from flowing through the cell, even under an applied voltage of 10 Volts.

Saturated steam at atmospheric pressure was introduced into the cathodic compartment and after a few minutes current started to flow through the cell and condensed liquor began to collect on the bottom of the cathodic compartment.

Steam was circulated through the heating coil and the supply was adjusted to maintain the catholyte liquor pool at a steady temperature of 90° C.

The brine supply rate was increased step-wise and excess brine flowed out of the anolyte gooseneck discharge pipe 125.

When the concentration of NaCl in the anolyte discharged through the gooseneck pipe 125 stabilized at about 275 - 270 gpl the rate of the fresh brine supply was thereafter maintained constant.

The temperature of the inlet brine was maintained at 55° C in run 1.

After a few hours of operation, all the parameters of the electrolysis process had reached a steady state, and the set of operative data as recorded are reported in Table 2 under run No. 1.

During the successive run No. 2, two parameters were varied, namely, the temperature of the brine introduced into the anodic compartment was lowered from 55° C to 30° C, as in the preceding Example 1, Run No. 3, to lower the temperature of the membrane, and the steam supply to the heating coil was slightly increased to increase the temperature of the catholyte liquor in the cell to 100° C.

After reaching steady conditions, the operative data of the electrolysis process were recorded as reported in Table 2 under run No. 2.

As indicated in the table, both the efficiency and the concentration of NaOH in the catholyte increased.

EXAMPLE 2

TABLE 2

| Type of diaphragm | | Permionic membrane | |
|---|---|---|---|
| Run number | | 1 | 2 |
| Hydrostatic head on anolyte | cm. | 20 | 20 |
| Feed brine concentration | gpl | 310 | 310 |
| Feed brine temperature | ° C | 55 | 30 |
| Average anolyte concentration | gpl | 275 | 270 |
| Anolyte temperature | ° C | 78 | 52 |
| Current density | A/sq. dm. | 35 | 35 |
| Cell voltage measured at electrodes | Volts | 3.6 | 3.7 |
| Catholyte temperature in cathodic compartment | ° C | 90 | 100 |
| Catholyte concentration: | | | |
| NaOH | gpl | 225 | 345 |
| NaCl | gpl | 1.2 | 1.3 |
| Chlorates | gpl | absent | absent |
| Cathodic current efficiency | % | 82 | 86 |

While we have illustrated types of horizontal diaphragm cells and types of vertical diaphragms cells in which this invention may be used, it will be understood that the method of the present invention is applicable to all types of diaphragm cells using either porous, water permeable diaphragms, water absorbent permionic diaphragms, or substantially water impermeable, ion permeable diaphragms and that instead of distributing steam through branch pipes to the interior of the cathodes, in many instances, it will only be necessary to introduce steam or heat to provide steam into the cathode compartments.

It is possible to maintain only a small amount of catholyte liquor in the cathodic compartment and to effectively apply the method of this invention to control the concentration of alkali metal hydroxide and to produce more concentrated alkali metal hydroxide solutions. A general improvement in electrolysis cell performance is realized, as is shown by the lower chlorate formation of Examples 1 and 2, and an improved overall process efficiency.

The method and apparatus of this invention lend themselves to special applications. Besides steam, other gaseous chemicals may be introduced into the cathodic compartment whereby particular compounds are formed and recovered from the cathode compartment by means of a chemical reaction with the caustic. For example, gaseous $CO_2$ can be fed into the cathodic compartment either in the mixture with steam, or separately, reacting with the caustic to produce alkali metal carbonate or bicarbonate solution, which is then recovered through the catholyte outlets. Other chemical compounds in gaseous or liquid phase may be fed into the cathodic compartment to produce a wide variety of special chemical compounds.

While certain specific embodiments and examples of the practice of this invention have been given, it will be understood that other methods of practicing the invention and other types of apparatus may be used within the spirit and scope of this invention.

What is claimed is:

1. The method of reducing the caustic film concentration on the cathode side of the diaphragms of electrolysis cells having an anode compartment, a cathode compartment, an anolyte in the anode compartment, a catholyte in the cathode compartment, a diaphragm separating said compartments, screen anodes and cathodes in said compartments, and means to conduct an electrolysis current to said anodes and from said cathodes, which comprises maintaining a volume of anolyte in the anode compartment larger than the volume of anolyte in the gap between the anode and cathode, circulating anolyte through said screen anodes and out of said cells, passing an electrolysis current between said anodes and cathodes, introducing steam into the cathode compartment, maintaining the anode compartment below the condensation temperature of the steam in the cathode compartment under steady state operation throughout the electrolysis process by said circulation, condensing steam on the cathode side of the diaphragms, dripping the condensate and the caustic film removed from the cathode side of the diaphragms into the bottom of the cathode compartment and recovering the catholyte liquor.

2. The method of claim 1, in which the anolyte is continuously cooled during the electrolysis.

3. The method of claim 1, in which the steam is superheated.

4. The method of claim 1, in which the steam is introduced into said cathode compartment continuously.

5. The method of claim 1, in which the steam is introduced into said cathode compartment intermittently.

6. The method of claim 1, in which the steam is formed from the catholyte in the cathode compartment.

7. The method of reducing caustic film concentration on the cathode side of the diaphragms and of increasing the concentration of the caustic produced in diaphragm electrolysis cells having an anode compartment with a hollow screen anode therein, a cathode compartment with a hollow screen cathode therein, a diaphragm separating said compartment, an anolyte in the anode compartment, a catholyte in the cathode compartment and means to pass an electrolysis current between said anode and said cathode, which comprises maintaining a volume of anolyte in the anolyte compartment several times larger than the volume of anolyte between the anode and cathode, passing anolyte through the hollow screen anode, passing anodic gases upward through the hollow screen anode and out of said cell while circulating anolyte into said cell through said hollow screen anode and out of said cell, condensing water on the cathode side of the diaphragms above the catholyte liquor level by maintaining the anode compartment below the temperature at which steam condenses to water during the electrolysis by said anolyte circulation, allowing the condensate to flow into the bottom of the cathode compartments and recovering the catholyte liquor so produced.

8. The method of reducing the caustic film concentration on the cathode side of the diaphragms and of increasing the concentration of the caustic produced in diaphragm electrolysis cells having an anode compartment with a hollow screen anode therein, a cathode compartment with a hollow screen cathode therein, a diaphragm separating said compartments, an anolyte in the anode compartment, a catholyte in the cathode compartment and means to pass an electrolysis current between said anode and said cathode, which comprises maintaining the catholyte chamber and the catholyte therein at a higher temperature than the anolyte chamber and the anolyte therein, passing anolyte through the hollow screen anode, passing anodic gases upward through the hollow screen anode and out of said cell while circulating anolyte into said cell through said hollow screen anode and out of said cell, condensing water on the diaphragm side of the cathodes by said temperature differential, caused by said anolyte circulation, to dilute and remove the caustic film on the diaphragm side of the cathodes, and recovering the caustic liquor so produced.

9. The method of diluting and renewing the aqueous cathodic film on the diaphragm side of the cathodes in diaphragm electrolysis cells having hollow screen anodes, which comprises maintaining a volume of anolyte in the anolyte compartment several times larger than the volume of anolyte between the anode and cathode, passing anolyte liquor through the hollow screen anodes, passing anodic gases through the hollow screen anodes and out of said cells, circulating anolyte liquor through said hollow screen anodes and out of said cells and condensing steam on the diaphragm side of the cathodes by maintaining the circulating anolyte temperature constantly below the temperature of the diaphragm side of the cathodes under steady state operation, dripping the condensate and removed film from the cathode side of the diaphragms into a catholyte pool in the bottom of the catholyte compartment, and recovering the catholyte liquor so produced.

10. The method of diluting and renewing the aqueous cathodic film on the diaphragm side of the cathodes in diaphragm electrolysis cells having hollow screen anodes and hollow screen cathodes therein and of increasing the strength of the catholyte liquor produced, which comprises constantly maintaining the catholyte chamber and the catholyte therein at a higher temperature than the anolyte chamber and the anolyte therein by circulating anolyte liquor through said hollow screen anodes and out of said cells, cooling said anolyte liquor and the anolyte chamber by said circulation, condensing water on the surfaces of the cathodes by said temperature differential to dilute the cathodic film on the cathode side of the diaphragms, flowing the condensate and removed cathodic film from the cathode side of the diaphragms and recovering the catholyte liquor so produced.

11. The method of conducting electrolysis in an alkali halide cell having an anode compartment containing a screen anode and a brine anolyte, a cathode compartment containing a cathode screen and a diaphragm between the anode and the cathode in contact with the cathode screen, which comprises circulating anolyte through said screen anode and out of said cell, conducting the electrolysis between the anode and the cathode, maintaining the level of catholyte in the cathode compartment low enough to provide a gas space in the cathode compartment adjacent to the cathode screen, supplying water vapor to said space during said electrolysis and maintaining the temperature of the anolyte in contact with the diaphragm at least 12° C below the catholyte temperature, to condense water from said vapor on the cathode during steady state operation of said cell.

* * * * *